United States Patent [19]

Shigekawa

[11] Patent Number: 4,583,927

[45] Date of Patent: Apr. 22, 1986

[54] SCREW ROTOR MECHANISM

[75] Inventor: Kazuo Shigekawa, Hyogo, Japan

[73] Assignee: Kabushiki Kaisha Kobe Seiko Sho, Kobe, Japan

[21] Appl. No.: 589,684

[22] Filed: Mar. 15, 1984

[30] Foreign Application Priority Data

Mar. 16, 1983 [JP] Japan ..... 58-44682
Mar. 16, 1983 [JP] Japan ..... 58-38622[U]

[51] Int. Cl.[4] ..... F01C 1/16; F01C 1/24
[52] U.S. Cl. ..... 418/150; 418/201
[58] Field of Search ..... 418/150, 201

[56] References Cited

U.S. PATENT DOCUMENTS

| | | | |
|---|---|---|---|
| 3,423,017 | 1/1969 | Schibbye | 418/201 |
| 3,773,444 | 11/1973 | Koch | 418/201 |
| 3,787,154 | 1/1974 | Edstrom | 418/201 |
| 4,028,026 | 6/1977 | Menssen | 418/201 |
| 4,088,427 | 5/1978 | Emanuelsson | 418/201 |
| 4,140,445 | 2/1979 | Schibbye | 418/201 |
| 4,350,480 | 9/1982 | Bammert | 418/201 |
| 4,406,602 | 9/1983 | Kasuya | 418/201 |
| 4,435,139 | 3/1984 | Astberg | 418/201 |

*Primary Examiner*—Leonard E. Smith

*Assistant Examiner*—Jane E. Obee

*Attorney, Agent, or Firm*—Oblon, Fisher, Spivak, McClelland & Maier

[57] ABSTRACT

A male and female screw rotor mechanism for use in compressors or the like, in which a female rotor (F) is formed with an addendum (Af) on the outer side of a pitch circle of each tooth thereof and a male rotor (M) is formed with a dedendum (Dm) on the inner side of a pitch circle at each root thereof complementarily to the addendum (Af) of the female rotor: the male rotor (M) including in the following side tooth profile thereof an arc (d1-e1) having the center thereof at the intersection (m) of the pitch circle (Pm) of the male rotor and a line connecting the centers (Of, Om) of the female and male rotors; the female rotor (F) including in the leading side tooth profile thereof a curve (d2-c2) generated by the point (d1) on the male rotor having an outer diameter (Tm) of the dimension of about $1.37 \times \overline{CD}$; and the female rotor having the addendum (Af) formed at a rate of about 1.7% to 2.3%; provided that the points (d1, d2) are located on the line connecting the centers of the male and female rotors and $\overline{CD}$ is a distance between the rotor centers.

2 Claims, 9 Drawing Figures

SCREW ROTOR MECHANISM

BACKGROUND OF THE INVENTION

1. Field of the Invention

This invention relates to a male and female screw rotor mechanism for use in screw compressors or the like, and more particularly to improvements in screw rotors of the type which consists of a female rotor with an addendum on the outer side of a pitch circle of its respective teeth and a male rotor having a deddendum on the inner side of a pitch circle of its respective teeth correspondingly to the addendum of the female rotor.

2. Description of the Prior Art

A screw compressor was originally invented by Krigar in Germany in about 1878 and ever since various improvements have been made in this connection. In place of the so-called symmetrically toothed rotors which were used in the original screw compressor, SRM (Svenska Rotor Maskiner Aktiebolag) of Sweden introduced in 1965 asymmetrically toothed rotors with markedly improved volumetric efficiency. An example of the asymmetically toothed rotors can be seen, for example, in Japanese Patent Publication No. 56-17559 which discloses rotors of the construction as schematically shown in FIG. 1.

In this case, it is intended to increase the theoretical volume by forming an adendum Af on the outer side of a pitch circle Pf of each tooth of a female rotor F and forming a corresponding deddendum Dm on the inner side of a pitch circle Pm at each root of a male rotor M, shaping the teeth of the female and male rotors in the shapes with the following characteristics.

(1) Female Rotor Tooth Shape (a) Tooth shape on the leading side

Profile n-d is formed by an arc having its center at the intersection of the pitch circle Pf and a line drawn through the centers (or axes) Of and Om of the female and male rotors, and <nmd is about 10 degrees. Point n is located on the interaxial line Of-Om.

Profile d-e is formed by an arc having its center at point k on an extension line of radius d-m. Point e is located on the pitch circle Pf.

(b) Tooth shape on the follower side

Profile n-c is an arc having its center at point m, and <nmd is about 10 degrees. Accordingly, <cmd is an arc of about 20 degrees.

Profile c-a is a generating curve which is determined by point h of the male rotor.

Profile b-a is an extension line of a straight line Of-b. Point a is located on the pitch circle Pf.

(2) Male Rotor Tooth Shape (a) Tooth shape on the leading side

Profile p-i is an arc having its center at the intersection of the pitch circle Pm and a straight line drawn through the centers Of and Om, and conforming with the arc n-d of the female rotor. Point p is located on the inter-axial line Of-Om of the rotors.

Profile i-j is a generating curve which is determined by the arc d-e of the female rotor. Point j is located on the pitch circle Pm.

(b) Tooth shape on the follower side

Profile p-h is an arc having its center at point m and conforms with the arc n-c of the female rotor.

Profile h-g is a generating curve which is determined by point b of the female rotor.

Profile g-f is a generating curve which is determined by a straight line b-a of the female rotor. Point f is located on the pitch circle Pm.

The present invention contemplates further improvement of the volumetric efficiency in screw rotors of this sort (which is about 83.99% in the particular example given above). It has been known in the art that the volumetric efficiency is largely influenced by the following three factors: the theoretical volume; the seal line length per unit theoretical volume; and the blow hole area per unit theoretical volume.

With regard to the theoretical volume, under the restrictions imposed by the predetermined distance $\overline{CD}$ (Om-Of) between the centers of the male and female rotors, an arrangement should be made in such a manner as to increase the theoretical volume to a maximum, namely, to increase the outer diameters of the male and female rotors so as to be as large as possible. However, this problem cannot be solved simply by increasing the outer diameters of the male and female rotors M and F. This is because mere enlargement of the outer diameters of the male and female rotors will result in a reduction in the tooth width of the female rotor F and hence in a material reduction in mechanical strength. This problem arises conspicuously particularly in the case of rotors with the conventional tooth shapes as shown in FIG. 1.

More specifically, as mentioned hereinbefore, the generating curve c-d in the conventional tooth shape of FIG. 1 is formed by point h, and partly located to the follower side by the angle <hn. Therefore, if the outer diameters of the rotors were increased, the female rotor would be largely scooped or recessed along the generating curve c-b, as a result reducing the tooth width of the female rotor. It follows that, in order to enhance the volumetric efficiency of the screw rotors of FIG. 1, it is necessary to define tooth shapes which will permit an increase in the outer diameters of the male and female rotors without an accompanying material reduction in the tooth width of the female rotor.

In addition, there is another problem which will arise as a result of mere enlargement of outer diameters of the male and female rotors, i.e., a problem concerning the seal line length and blow hole area. That is to say, mere enlargement of the outer diameters of the male and female rotors will invite increases in the seal line length and the blow hole area, lowering the volumetric efficiency to the contrary.

SUMMARY OF THE INVENTION

As a consequence of an extensive study in this regard, the present inventors have found that, in a case where the outer diameters of male and female rotors are increased with a view to improving the volume efficiency, the dimensional rate of addendum on the female rotor, [(outer diameter of female rotor−diameter of pitch circle of female rotor)/(2×(diameter of pitch circle of female rotor))]×100%, has a great influence. For instance, the dimensional rate of addendum in the conventional example of FIG. 1 is about 2.79 which is outside an optimum range to be explained in greater detail hereinbelow.

It is an object of the present invention to provide a couple of male and female rotors with optimum tooth shapes and dimensional rate of addendum for the female rotor, which permit an increase in the theoretical volume by enlarging the outer diameter of either or both the male and female rotors to a significant degree as compared with a reduction in the tooth width of the female rotor.

It is another object of the present invention to provide a couple of male and female rotors in which the addendum on the female rotor is so shaped as to reduce the blow hole area for the purpose of increasing the volumetric efficiency of the rotors.

According to a fundamental aspect of the present invention, there are provided a couple of male and female screw rotors of the type in which the female rotor (F) is formed with an addendum (Af) on the outer side of a pitch circle (Pf) of each tooth thereof and the male rotor (M) is formed with a deddemdum (Dm) on the inner side of a pitch circle (Pm) of each root thereof complementarily to the addendum of the female rotor, characterized in that: the male rotor (M) includes in the leading side tooth profile an arc (dl-el) having the center thereof at the intersection (m) of the pitch circle (Pm) of the male rotor and a line connecting the centers (Of, Om) of the female and male rotors; the female rotor (f) includes in the leading side tooth profile a curve (d2-c2) generated by a point (d1) on the male rotor (M); the outer diameter (Tm) of the male rotor (M) is in the dimension of about $1.37\times\overline{CD}$; and the addendum (Af) of the female rotor (F) is formed at a rate of about 1.7% to 2.3%; provided that the points (d1, d2) are located on a straight line connecting the centers of the male and female rotors and $\overline{CD}$ is a distance between the two rotor centers.

According to another aspect of the present invention, there are provided a couple of male and female rotors with the tooth shapes as described above, in which the female rotor (F) includes in the follower side tooth profile a curve (a-l') generated by point (f) on the male rotor (M), and the male rotor (M) includes in the follower side tooth profile a curve (f-q') generated by a point (l') on the female rotor (F), provided that the point (a) is located on the pitch circle (Pf) of the female rotor (F), the point (f) is located on the pitch circle (Pm) of the male rotor, and the point (q') is located on the root circle of the male rotor (M).

The above and other objects, features and advantages of the present invention will become apparent from the following description and appended claims, taken in conjunction with the accompanying drawings which show by way of example some illustrative embodiments of the invention.

DETAILED DESCRIPTION OF THE PREFERRED EMBODIMENTS

Figure 2:
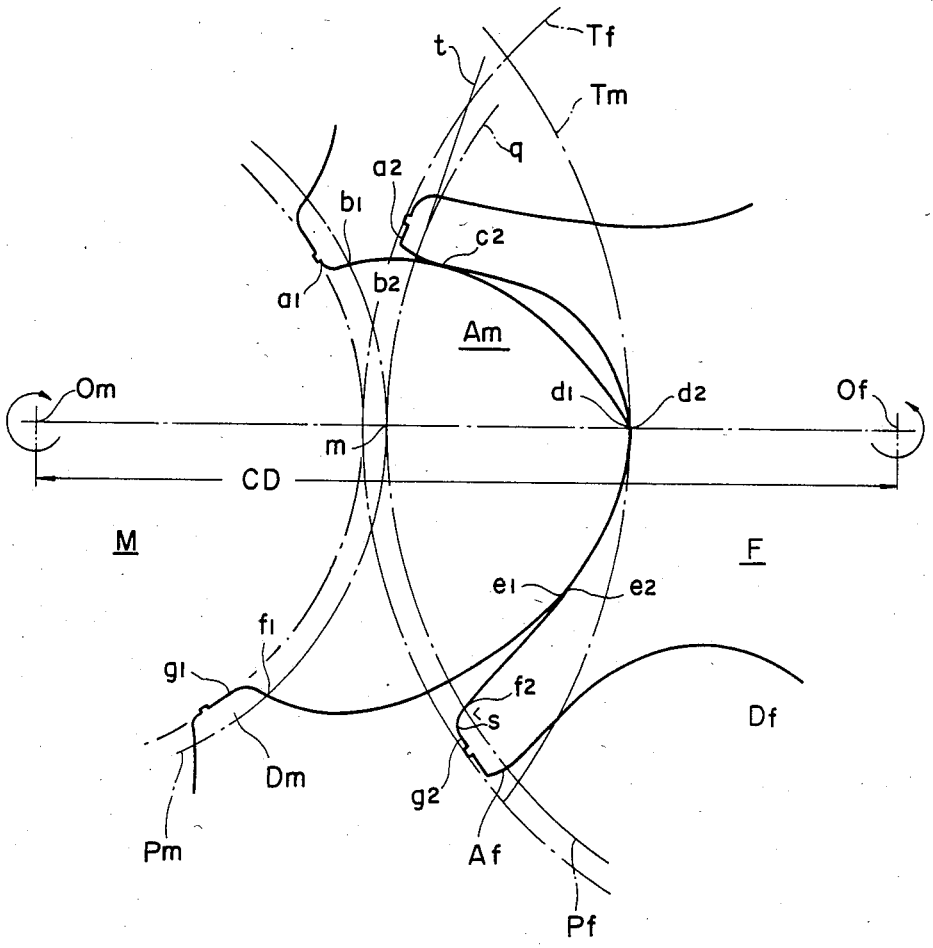
FIG. 2 is a view similar to FIG. 1 but showing tooth shapes of male and female rotors according to the present invention.

Referring to FIG. 2, there is shown more particularly the tooth shapes of a female rotor F and a male rotor M in one preferred embodiment of the invention. According to the present invention, the female and male rotors F and M are provided with teeth of the following shapes.

TOOTH SHAPE OF FEMALE ROTOR

The female rotor F is provided with an addendum Af on the outer side of a pitch circle Pf of each tooth and with a deddendum Df on the inner side of the pitch circle Pf at each root. The tooth shapes on the trailing and leading sides of the female rotor F are as follows.

(a) Tooth shape on the leading side

The profile d2-e2 is an arc having its center at the intersection of the pitch circle Pf and a straight line drawn between the centers Of and Om of the two rotors, and the angle d2me2 is about 40 degrees. Point d2 is located on line Of-Om.

The profile e2-f2 is a tangential line passing through point e2, and point f2 is located on the pitch circle Pf.

The profile f2-g2 is constituted by an arc passing through point f2 and having its center at point S on a line drawn at right angles with line e2-f2. Point g2 is located on an arc having its center at Of.

(b) Tooth shape on the follower side

The profile d2-c2 is constituted by a generated curve which is determined by point d1.

The profile c2-b2 is constituted by an arc having its center at point t on a line tangential to the pitch circle Pf and passing through point b2 (on the pitch circle Pf).

The profile b2-a2 is constituted by an arc having its center at point q on the pitch circle Pf. Point a2 is located on an arc having its center at Of.

TOOTH SHAPE OF MALE ROTOR

The male rotor M is provided with a deddemdum Dm at each root correspondingly to the addendum Af of the female rotor F. The tooth shapes on the leading and trailing sides of the male rotor M are as follows.

(a) Tooth shape on the leading side

The profile d1-e1 is an arc having its center at the intersection point m of the pitch circle Pm and a straight line drawn between the centers Of and Om of the female and male rotors, and corresponding to the arc d2-e2 of the female rotor F. Accordingly, the angle d1me1 is the same as the angle <d2me2. Point d1 is located on the line through the rotor centers Of and Om.

The profile e1-(f1)-g1 is a generating curve which is determined by the line e2-(f2)-g2 of the female rotor F. Point f1 is located on the pitch circle Pm,and point g1 is located on the tooth root circle of the male rotor M.

(b) Tooth shape on the trailing side

The profile d1-b1 is a generating curve which is determined by the arc c2-b2 of the female rotor F. Point b1 is located on the pitch circle Pm.

The profile b1-a1 is an arc corresponding to the arc b2-a2 of the female rotor F. Point a1 is located on the tooth root circle of the male rotor M.

Figure 3:
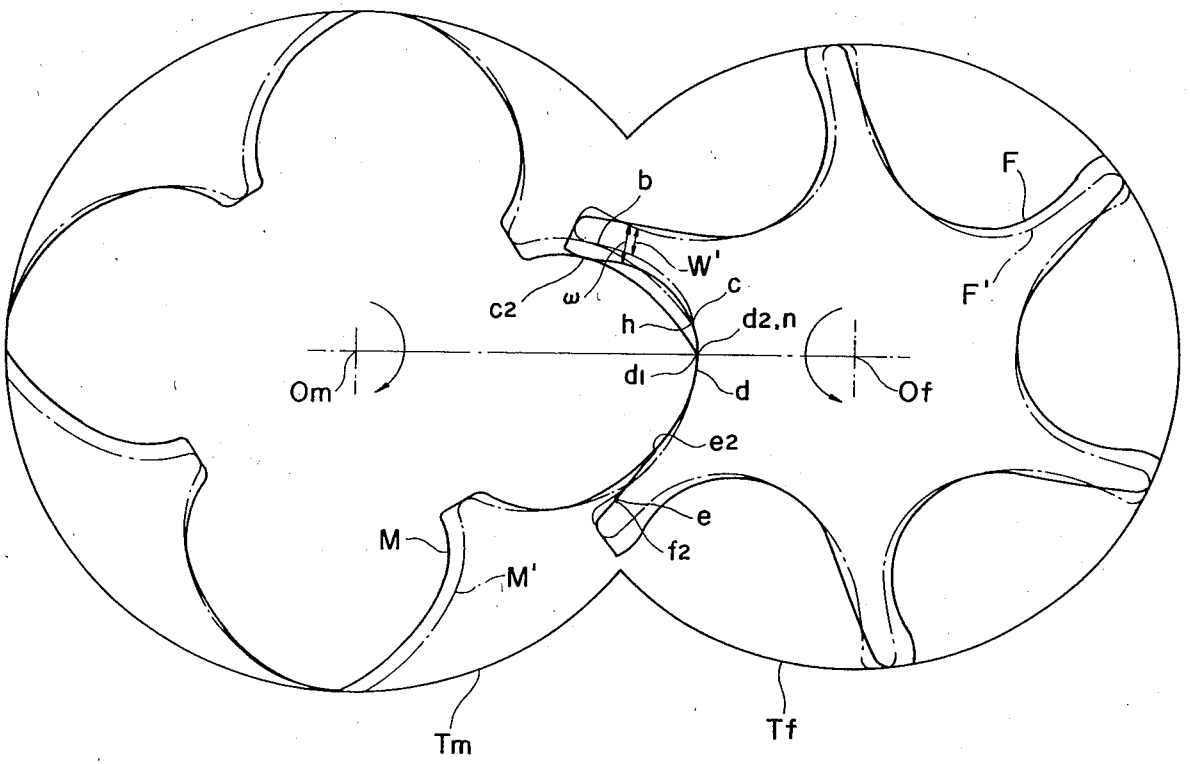
FIG. 3 is a schematic illustration showing the tooth shapes of the conventional rotors and the rotors of FIG. 2 in an overlapped state for comparative purposes.
Figure 4:
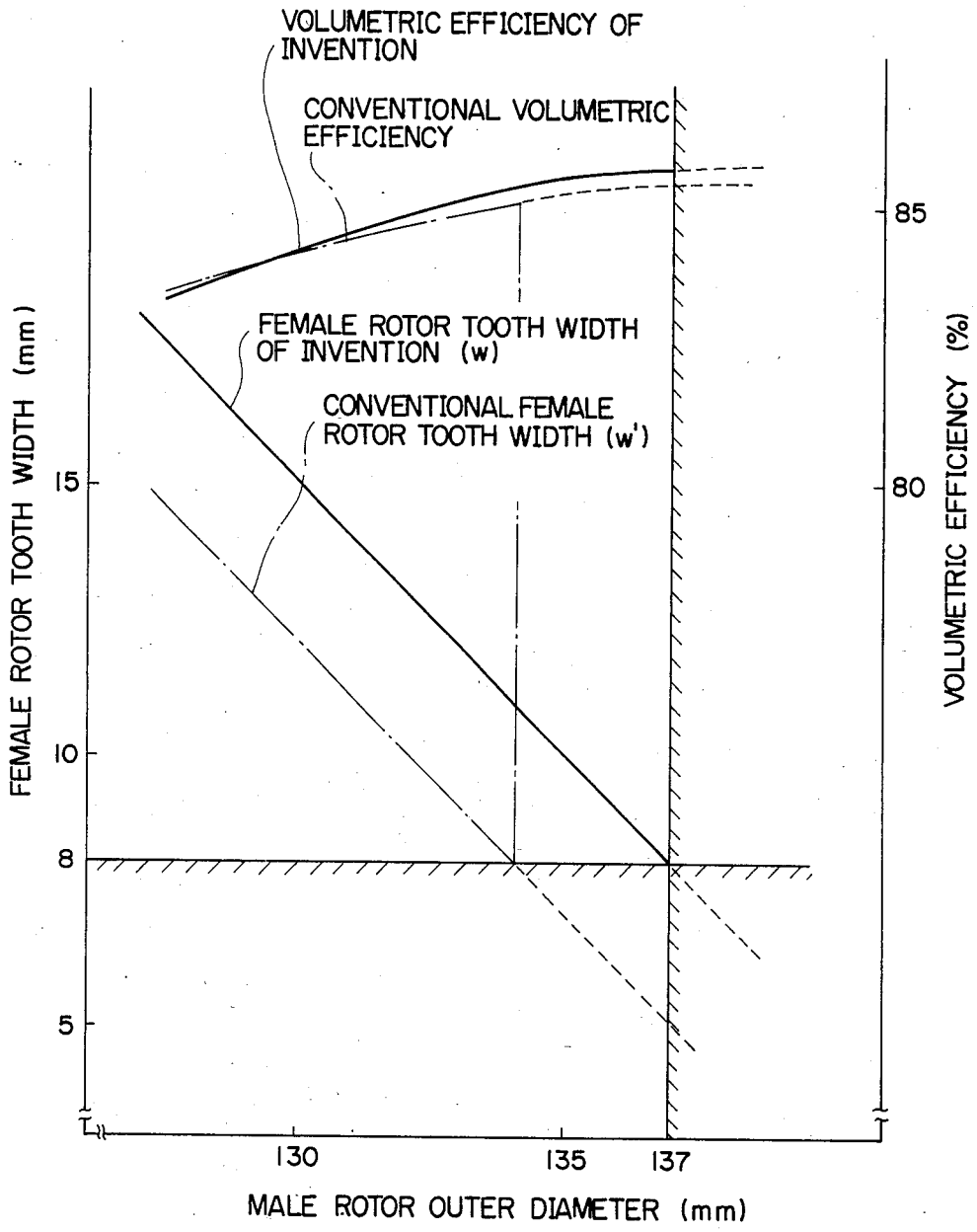
FIG. 4 is a diagram of female rotor tooth thickness and volume efficiency (vertical axis) versus male rotor diameter (horizontal axis), plotting the tooth thickness and volume efficiency curves of the rotors according to the invention in comparison with the counterparts of rotors of the conventional tooth shapes.

In this particular embodiment of the present invention, the female and male rotors F and M are formed to have the above-defined tooth shapes to secure a greater tooth width for the female rotor as compared with the conventional tooth shapes (FIG. 1), as is clear from FIG. 3. Denoted at F and M in FIG. 3 are female and male rotors according to the present invention (indicated by solid line) and at F' and M' are conventional female and male rotors which have the same outer diameters (tm, Tf'). The reference characters w and w' indicate the minimum tooth width of the female rotor of the invention and the conventional female rotor, respectively. In FIG. 3, the tooth width w' is about 62% of the tooth thickness w. Both of the tooth widths w and w' vary depending upon the outer diameter of the respective male rotor as shown in FIG. 4 (which shows a case where the inter-axis distance $\overline{CD}=100$ mm). It is clear from FIG. 4 that the tooth width w according to the present invention is greater than the tooth width w' of the conventional rotor.

The above-mentioned difference in tooth width is attributable to the difference in shape between the generating curves d2-c2 and c-b of the female rotors F and F'. More particularly, the generating curve c-b of the female rotor F' which is determined by point h of the male rotor M' is scooped to a greater degree as long as the tooth width is concerned. On the other hand, the generating curve d2-c2 of the female rotor F is determined by point d1 of the male rotor M (which is located on the inter-axis line Om-Of), so that its degree of recession which causes the reduction in tooth width is relatively small.

The female rotor F of the present embodiment with the profile e2-f2 of a straight line has an advantage in a case where the female rotor F is fabricated by a hobbing operation since it is possible to shape the profile successively by individual hob blades without overlapped cutting. On the other hand, the conventional female rotor F' with an arcuate profile at d-e, which has to be cut simultaneously by a plurality of hob blades for overlapped cutting, is disadvantageous from the standpoint of machining conditions.

Referring to FIG. 2, it has been experimentally proved that, when the inter-axis distance $\overline{CD}$ of the male and female rotors is 1, practically the maximum theoretical volume is obtained from a male rotor which has dimensions of about $1.37\times\overline{CD}$ in the outer diameter Tm. In other words, it has been revealed that, although theoretically an increase in the outer diameter Tm is reflected by an increase in the theoretical volume, it naturally causes a reduction in the tooth thickness of the female rotor, so that the maximum outer diameter Tm should be $1.37\times\overline{CD}$ at in consideration of the value of minimum allowable tooth thickness.

The tooth width or thickness of the female rotor is determined depending upon the minimum allowable mechanical strength and from the standpoint of machinability in the manufacturing process and durability of the rotor in service. According to the experiments conducted by the present inventors, it has been found that, in a case where the inter-axis distance $\overline{CD}$ of the rotors is 100 mm, the minimum allowable value for the tooth thickness of the female rotor is about 8 mm. The above-defined outer diameter ($1.37\times\overline{CD}$) for the male rotor M has been determined on the basis of the minimum allowable value (8 mm) of the female rotor tooth thickness. Accordingly, of the volume efficiency curves which are shown in FIG. 4 with respect to the rotors in the above-described embodiment of the invention and the rotors of the conventional tooth shapes, those parts which fall outside the allowable range are indicated by broken lines. In this connection, it will be clear from FIG. 4 that the volume efficiency is gradually increased by enlargement of the outer diameter of the male rotor in both the embodiment of the present invention and the conventional example.

Figure 6:
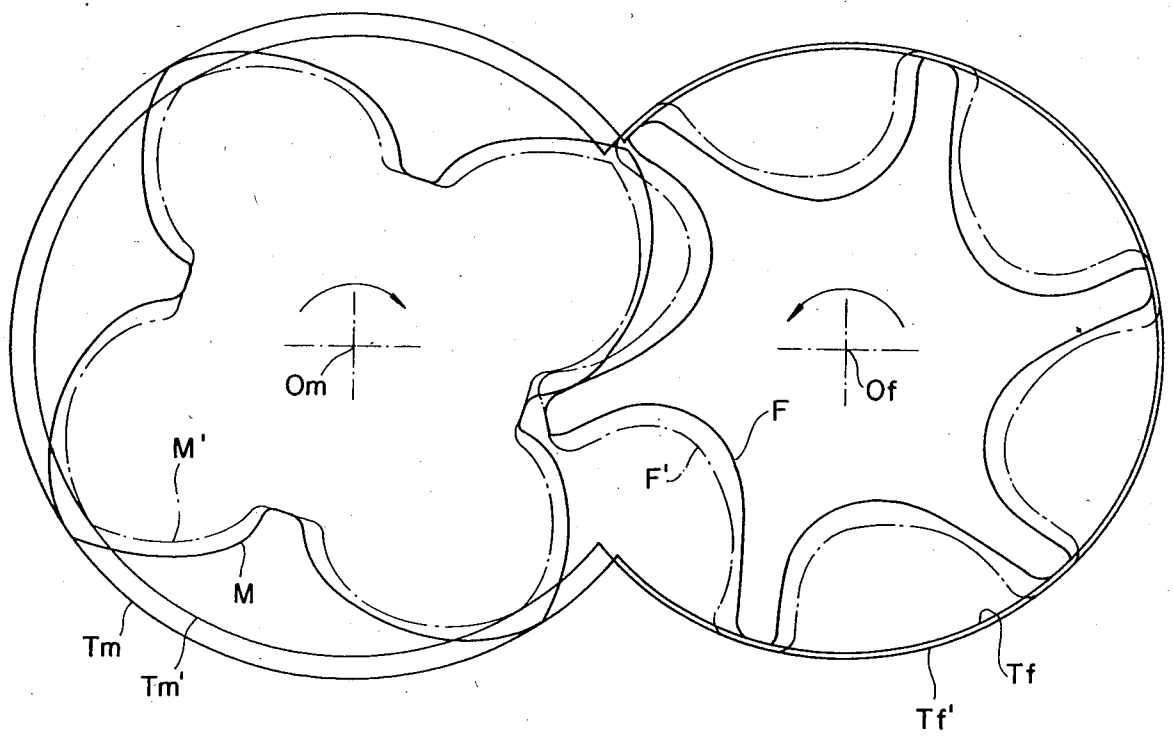
FIG. 6 is a tooth shaped diagram showing differences in shape and dimensions between the rotors according to the present invention and the conventional rotors.

In the foregoing description, it has been explained that the volume efficiency can be improved by enlargement of the outer diameter of the male rotor. Similarly, the volume efficiency can be theoretically enhanced by enlargement of the outer diameter of the female rotor if the points of seal line length and blow hole area are disregarded. However, the present inventors have found an interesting fact, in connection with the problems of the seal line length and blow hole area, that the volume efficiency can be improved by rather minimizing the outer diameter of the female rotors as compared with the conventional counterpart. FIG. 6 comparatively shows the outer diameters of the male and female rotors in the embodiment of the invention and the conventional example.

The outer diameter of a female rotor is determined by the sum of the dimensions of its pitch circle and addendum. The dimension of the pitch circle is automatically determined by the inter-axis distance $\overline{CD}$ of the male and female rotors and their tooth ratio. Therefore, the outer diameter of the female rotor is determined by the dimension or dimensional ratio of the addendum.

Figure 5:
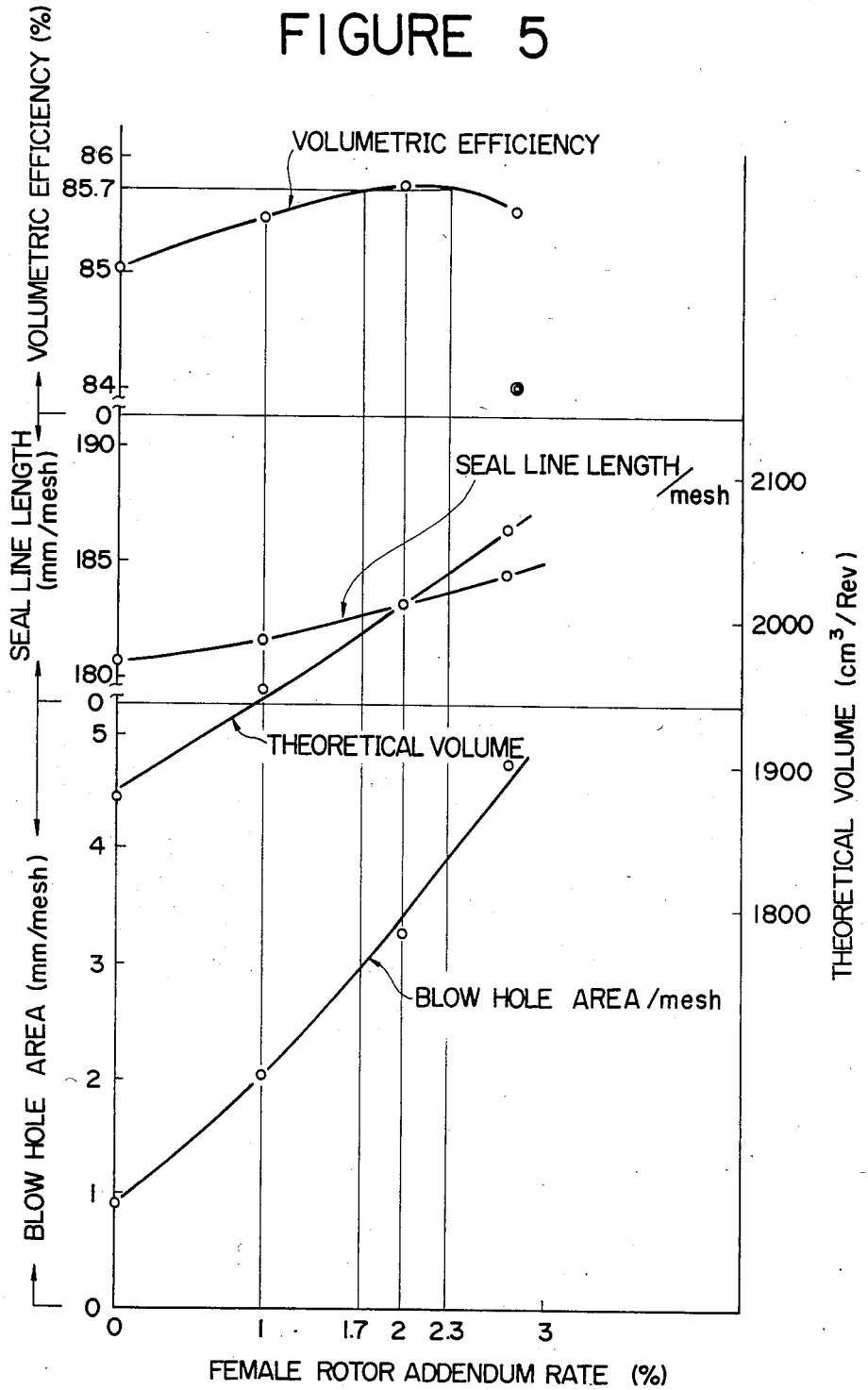
FIG. 5 is a diagram plotting variations in the blow hole area, seal line length, theoretical volume and volume efficiency (vertical axis) against the dimensional rate of female rotor addendum (horizontal axis)

FIG. 5 shows the results of experiments conducted by the present inventors, studying variations in the volume efficiency in relation with the seal line length and blow hole area by changing the dimensional rate of addendum on the female rotor. More specifically, the results show that the volume efficiency curve reaches the maximum when the addendum rate is 2%. As mentioned hereinbefore, the addendum rate in the conventional example is 2.79 at which the volume efficiency is about 0.84 (indicated by a mark "◎" in FIG. 5). Thus, the embodiment of the present invention far excels the volumetric efficiency of the conventional example at any addendum rate in the range of 0%–3% according to the invention, and marks an especially high volumetric efficiency of 85.7 at an addendum rate in the vicinity of 2%, namely, in the range of 1.7% to 2.3% wherein the female rotor addendum rate (%) is obtained by the following formulae" $((T_{fdia}-P_{fdia})\times\frac{1}{2})/P_{fdia}\times 100$ (%).

The following table shows the particulars in dimensions of the rotors according to the invention in comparison with the counterparts of the conventional rotors.

| | Conventional | Invention |
|---|---|---|
| Addendum rate (%) | 2.79 | 2.00 |
| Male rotor outer diam. (mm) | 127.5 | 137.0 |
| Female rotor outer diam. (mm) | 127.5 | 124.8 |
| Rotor length | | |
| M. rotor outer diam. | 1.6500 | 1.5356 |
| Helical angle (°) | 300 | 300 |
| Rotor inter-axis distance (mm) | 100 | 100 |
| Theoretical volume ($cm^3$/REV) | 1689.3 | 2010.8 |

-continued

| | Conventional | Invention |
|---|---|---|
| Total seal line length (mm) | 541.7 | 610.1 |
| Total seal line length | | |
| Theoretical volume (mm/cm$^3$) | 0.3207 | 0.30343 |
| Total blow hole area (mm$^2$) | 23.4 | 10.9 |
| Total blow hole area | | |
| Theoretical volume (mm$^3$/cm$^3$) | 0.01385 | 0.00542 |
| Minimum F. rotor tooth width (mm) | 14.4 | 8.0 |
| Root diameter of M. rotor (mm) | 72.5 | 75.2 |
| Root diameter of F. rotor (mm) | 72.5 | 63.0 |
| Volume efficiency | 83.99 | 85.75 |

As is clear from the foregoing particular embodiment, the rotors according to the present invention realizes a significant increase in the theoretical volume along with reductions in the seal line length and blow hole area per unit theoretical volume as compared with the conventional rotors. As a result, the volumetric efficiency can be improved drastically from the value of the conventional rotors.

Figure 7:
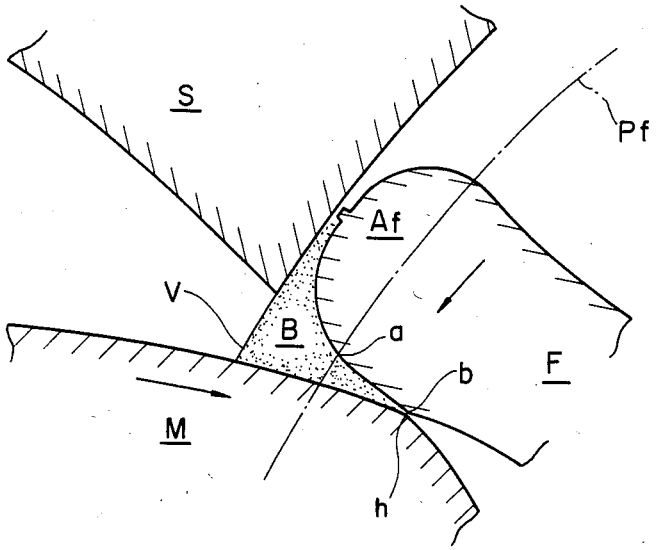
FIG. 7 is a schematic illustration employed for explanation of the blow hole area.

As mentioned hereinbefore, the volume efficiency is also largely influenced by the blow hole area which appears, as shown particularly in FIG. 7, between a time point when the cusp S of a screw compressor casing disengages from a tooth of the male rotor M and a time point when it comes into engagement with a tooth of the female rotor F, forming a blow hole of compressed air. The area of the blow hole is generally expressed by way of the area of a substantially triangular shape which is defined by a tooth surface of the male rotor M, a surface of the addendum Af of the female rotor F and an extension line V of the cusp wall at a time point when a tooth point h on the male rotor M comes into contact with a tooth point b on the female rotor F. The conventional rotors of FIG. 1 have a blow hole area as indicated by dotted region B in FIG. 7.

In another embodiment of the present invention, the volumetric efficiency of the rotors is further enhanced by improving the shape of addendum Af of the female rotor F in such a manner as to reduce the blow hole area. More specifically, in the second embodiment of the invention, the profile a-l' on the leading side of the female rotor tooth is formed by a curved generating line which is determined by point f on the male rotor, while the profile f-q' on the follower side of the male rotor tooth is formed by a generating curve which is determined by point l' on the female rotor. In the foregoing definition, point a is a point on the pitch circle of the female rotor, point f is a point located on the pitch circle of the male rotor and point q' is a point located on the root circle of the male rotor. With these tooth shapes, the addendum of the female rotor bulges out in a direction of reducing the blow hole area.

Figure 1:
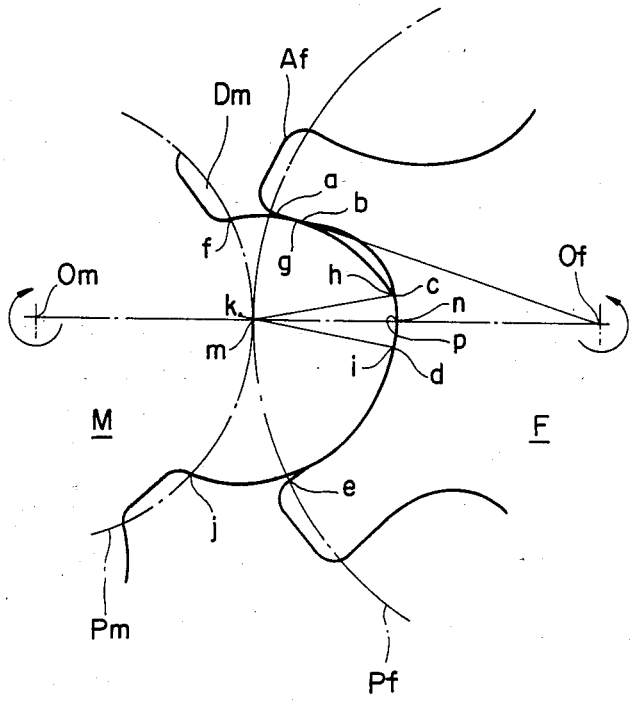
FIGURE 1 PRIOR ART
FIG. 1 is a schematic illustration of tooth shapes of conventional male and female rotors.

Now, the second embodiment of the invention is described more particularly with reference to FIGS. 8 and 9, in which the female and male rotors are formed which the same tooth shapes as in the conventional rotors of FIG. 1 for convenience of explanation, except for the feature points which will be discussed in greater detail hereinbelow. Those parts which are common to the foregoing embodiment are designated by common reference characters and their description is omitted to avoid unnecessary repetition.

Figure 8:
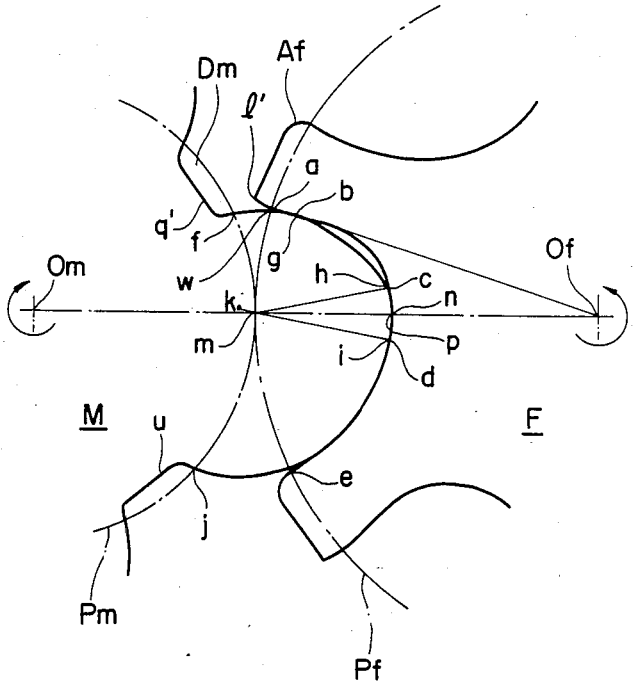
FIG. 8 is a schematic view of male and female rotors in the second embodiment of the invention.
Figure 9:
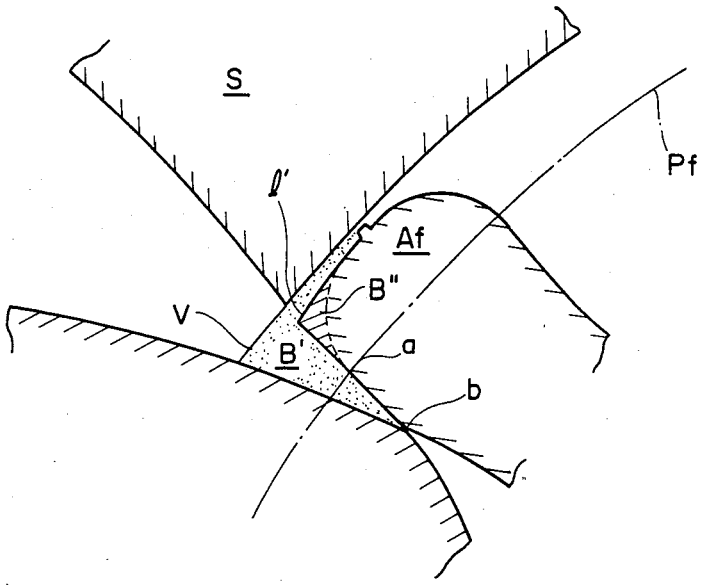
FIG. 9 is an enlarged schematic view of the male and female rotors of FIG. 8 with a reduced blow hole area.

The rotors in the embodiment of FIGS. 8 and 9 differ from the first embodiment in the profile a-l' on the leading side of the female rotor tooth shape and in the profile f-q' on the trailing side of the male rotor tooth shape. More specifically, the profile a-l' is formed by a generating curve which is defined by point f on the male rotor M, while the profile f-q' is formed by a generating curve which is determined by point l' on the female rotor F, provided that point f is located on the pitch circle Pm of the male rotor M, and point q' is located on the root circle of the male rotor M.

The shape of the addendum Af on the female rotor F is shown on an enlarged scale in FIG. 9. As clear therefrom, the addendum Af is more bulged out in a direction of reducing the blow hole area as compared with the conventional addendum. The blow hole area in this embodiment is indicated by a dotted region B', which is equal to the conventional blow hole area B minus the bulged area B'' (the hatched area) of the addendum Af. Thus, in this case the volumetric efficiency can be improved to an extent corresponding to the reduction in the blow hole area.

Although the profile b-a of the female rotor is formed by a straight line in the embodiment of FIGS. 8 and 9, it may be formed by an arc passing through point a (a point on the pitch circle Pf) and having its center on a line tangential to the pitch circle Pf, while profiling h-f of the male rotor M by a curve which is generated by the arc b-a of the female rotor F if desired.

It will be understood from the foregoing description that, in a basic form of the present invention, the profile d2-c2 on the leading side of the tooth shape of the female rotor is formed by a curve which is generated by point d1 of the male rotor M located on an inter-axis line of the rotors thereby securing a maximum tooth width for the female rotor and securing a maximum tooth width for the female rotor while permitting an increase the theoretical volume by enlargement of the outer diameter of the male rotor. The theoretical volume can be increased to a maximum by holding the outer diameter of the male rotor in the dimension of about $1.37\times\overline{CD}$. Further, the seal line length and blow hole area per unit theoretical volume can be reduced by holding the addendum rate of the female rotor in the range of about 1.7% to 2.3%. The invention makes it possible to attain a drastically improved volumetric efficiency of 85.7% or higher in contrast to the conventional volumetric efficiency of 83.99%, even without additionally employing the improved addendum shape of the second embodiment.

Obviously, numerous modifications and variations of the present invention are possible in light of the above teachings. It is therefore to be understood that within the scope of the appended claims, the invention may be practiced otherwise than as specifically described herein.

What is claimed is:

1. A screw rotor mechanism for using compressors or other devices, comprising:

a male and female screw rotor wherein said female rotor (F) is formed with an addendum (AF) on an outer side of a pitch circle of each tooth thereof and said male rotor (M) is formed with a dedendum (Dm) on an inner side of a pitch circle at each root thereof complementary to said addendum (Af) of the female rotor;

said male rotor (M) including in a follower side tooth profile thereof an arc (d1-e1) having a center thereof at an intersection (m) of a pitch circle (Pm) of said male rotor and a line connecting centers (Of, Om) of said female and male rotors;

said female rotor (F) including in a leading side tooth profile thereof a curve through first and second points (d2, c2), said curve being generated by a third point (d1) on said male rotor having an outer diameter (Tm) of a dimension of approximately $1.37 \times \overline{CD}$; and said female rotor having said addendum (Af) formed at a rate of approximately 1.7% to 2.3% wherein said first and third points (d1, d2) are located on a straight line connecting said centers of said male and female rotors and $\overline{CD}$ is a distance between said rotor centers.

2. A screw rotor mechanism for use in compressors or other devices, comprising:

a male and female screw rotor wherein said female rotor (F) is formed with an addendum (Af) on an outer side of a pitch circle of each tooth thereof and said male rotor (M) is formed with a dedendum (Dm) on an inner side of a pitch circle at each root thereof complementary to said addendum (Af) of said female rotor;

said female rotor (F) including in a follower side tooth profile thereof a first curve (a-l') through a first and second point (a, l') generated by a third point (f) on said male rotor (M), wherein said third point (f) comprises a point on the trailing side of said male rotor and which intersects the pitch circle of the male rotor and said male rotor (M) including in a follower side tooth profile thereof a second curve (f-q') through a fourth and fifth point (f-q') generated by a sixth point (l') on said female rotor (F), said first point (a) is located on a pitch circle (Pf) of said female rotor (F), said third point (f) on said male rotor is located on said pitch circle (Pm) of said male rotor (M), and wherein said fifth point (q') of said second curve is located on a root circle of said male rotor (M), said female rotor (F) including in a leading side tooth profile thereof a third curve (d2, c2) through sixth and seventh points (d2, c2), said third curve being generated by an eighth point on said male rotor having an outer diameter of a dimension of approximately $1.37 \times \overline{CD}$; and said sixth and eighth points (d1, d2) are located on a straight line connecting said centers of said male and female rotors and $\overline{CD}$ is a distance between said rotor centers.

* * * * *